US005526781A

United States Patent [19]

Sugiyama et al.

[11] Patent Number: 5,526,781

[45] Date of Patent: Jun. 18, 1996

[54] OIL PAN FOR AN INTERNAL COMBUSTION ENGINE

[75] Inventors: Izumi Sugiyama; Yoshihito Tsuji, both of Saitama-ken, Japan

[73] Assignee: Honda Giken Kogyo Kabushiki Kaisha, Tokyo, Japan

[21] Appl. No.: 445,739

[22] Filed: May 22, 1995

[30] Foreign Application Priority Data

May 27, 1994 [JP] Japan ..... 6-137977

[51] Int. Cl.[6] ..... F02F 7/00

[52] U.S. Cl. ..... 123/195 C; 184/106

[58] Field of Search ..... 123/195 C; 184/106

[56] References Cited

FOREIGN PATENT DOCUMENTS 63-170558 11/1988 Japan .

*Primary Examiner*—Noah P. Kamen

*Attorney, Agent, or Firm*—Armstrong, Westerman, Hattori, McLeland & Naughton

[57] ABSTRACT

An oil pan for an internal combustion engine is made of cast aluminum alloy and has a first flange for attachment to the cylinder block and a second annular flange for attachment to the transmission case. Access holes near a bottom end of the second annular flange allow access to the heads of mounting bolts extending through the first flange. The first flange can be securely clamped to the opposing mounting of the cylinder block because all of the mounting bolts can directly clamp the first flange onto the mounting surface. Annular ribs surround the access holes and are connected together by a connecting rib so as to ensure a sufficient rigidity of the second flange. As a result, the sealing performance can be readily ensured and a vibration free power structure can be achieved.

4 Claims, 7 Drawing Sheets

OIL PAN FOR AN INTERNAL COMBUSTION ENGINE

TECHNICAL FIELD

The present invention relates to an oil pan for an internal combustion engine, and in particular to an oil pan which is formed by a casting process.

BACKGROUND OF THE INVENTION

It is conventional to connect a cylinder block, a transmission case and a cast oil pan with each other so as to improve the overall rigidity of the engine power plant and to reduce the vibration of the engine as disclosed in Japanese patent laid open publication (kokai) No. 63-170558.

According to this conventional structure, an annular flange is provided along the upper edge of the oil pan for attachment to the cylinder block, and another annular flange is provided on a surface of the oil pan perpendicular to the axial center line of the crankshaft for attachment to an opposing surface of the transmission case. Mounting bolts are provided for the mounting holes of the flange for attachment to the cylinder block near the intersection between these two annular flanges, and these mounting bolts are a pair of long threaded bolts which pass through the annular flange for attachment to the transmission case. The heads of these long threaded bolts are supported by the lower end of the flange for attachment to the transmission case. Interference is thereby avoided between the mounting bolts and the two annular flanges.

However, according to this conventional arrangement, it is not possible to directly clamp the flange during attachment to the mounting surface of the cylinder block, and it is therefore difficult to achieve a contact pressure sufficient for sealing. As a result, the structure of the power plant is undesirably complex. The long threaded bolts contribute to rigidity of the flange and it is difficult to modify the flange so as to directly clamp it to the mounting surface of the cylinder block.

BRIEF SUMMARY OF THE INVENTION

In view of such problems in the prior art, a primary object of the present invention is to provide an oil pan for an internal combustion engine which can be securely attached to the mounting surfaces of the cylinder block and the transmission case without requiring a complex overall structure.

A second object of the present invention is to provide an oil pan for an internal combustion engine which can be securely attached to the mounting surfaces of the cylinder block and the transmission case while providing a sufficient overall rigidity to the power plant.

A third object of the present invention is to provide an oil pan for an internal combustion engine which is suitable for fabrication by a casting process.

These and other objects of the present invention can be accomplished by providing an oil pan for an internal combustion engine which includes a main body including a pan-shaped bottom wall, a first annular flange for attachment to a cylinder block, and a second annular flange for attachment to a transmission case. The first and second annular flanges have substantially perpendicular flange surfaces intersecting at a longitudinal end of the main body, a plurality of first mounting holes provided circumferentially along the first flange, a plurality of second mounting holes provided circumferentially along the second flange, and access holes provided in parts of the bottom wall adjacent to a bottom end of the second flange. The access holes allow access to heads of mounting bolts in the first mounting holes. An annular rib is formed around each of the access holes, and a connecting rib is formed in a part of the bottom wall and has a certain depth in a direction perpendicular to the flange surface of the first flange and connects the annular ribs with each other.

Thus, the first flange can be securely clamped onto the opposing mounting of the cylinder block because all of the mounting bolts can directly clamp the first flange onto the mounting surface. Furthermore, the annular rib and the connecting rib ensure rigidity of the second flange, and the resulting power unit is provided with a high rigidity. Thus, the sealing performance can be ensured, and a highly vibration free power structure is achieved. These effects are enhanced when the oil pan is made of cast metal or alloy.

To further increase the rigidity of the oil pan, the oil pan may further comprise annular bosses surrounding the second mounting holes, in which case the connecting rib is additionally connected to the annular bosses. Also, a pair of reinforcement ribs can be provided in the bottom wall extending from the first flange and to a part of the second flange adjacent to a corresponding one of the annular bosses.

To allow servicing of the transmission or the torque converter without removing the oil pan from the engine, a maintenance hole is provided in the bottom wall so as to allow access to an opposing surface of the transmission case. In this case, a part of the connecting rib can be formed by sections of a semi-cylindrical part of the bottom wall surrounding the maintenance hole.

BRIEF DESCRIPTION OF THE DRAWINGS

The present invention is described in the following with reference to the appended drawings, in which.

DETAILED DESCRIPTION OF THE PREFERRED EMBODIMENTS

Figure 1:
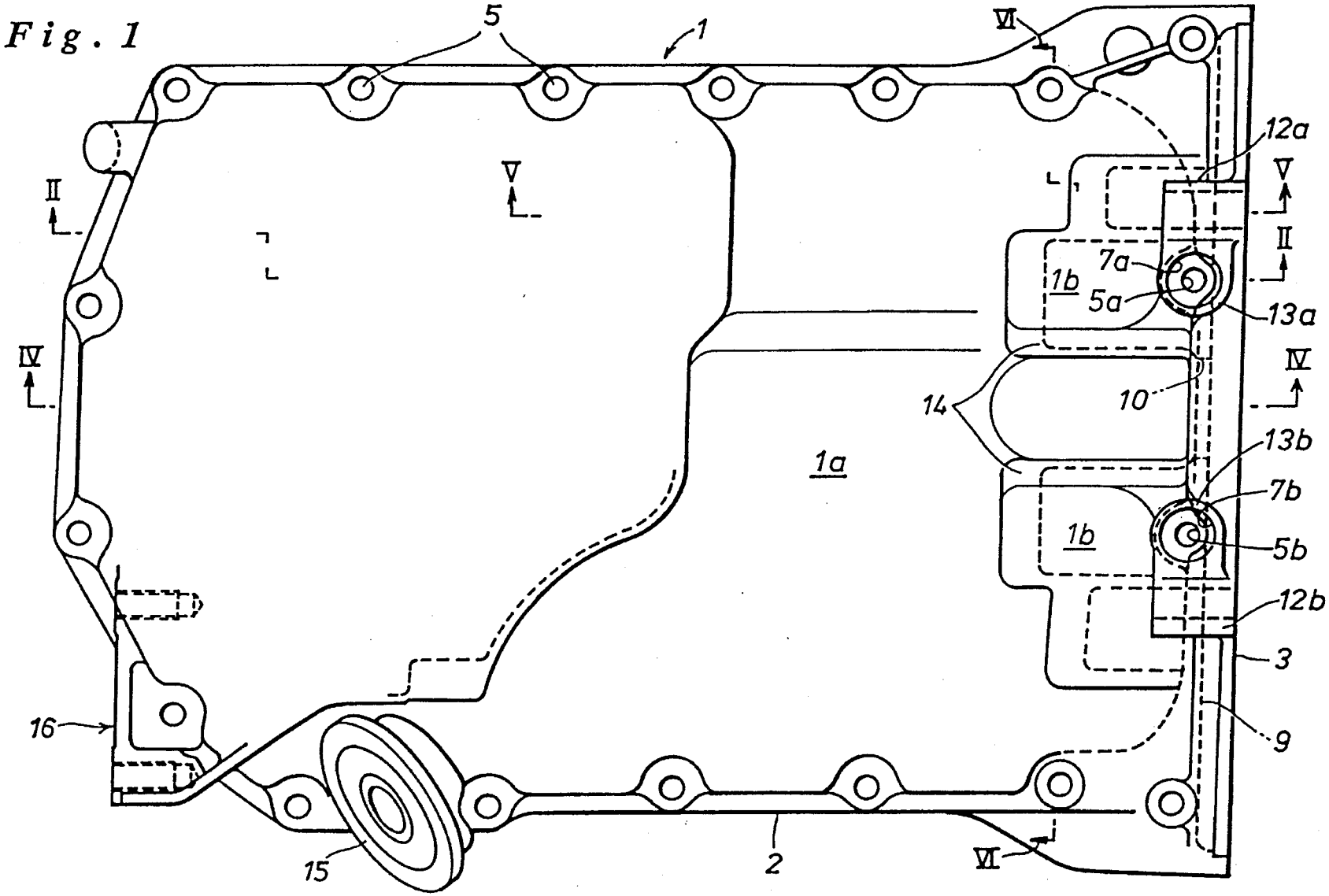
FIG. 1 is a bottom view of an embodiment of the oil pan according to the present invention.
Figure 2:
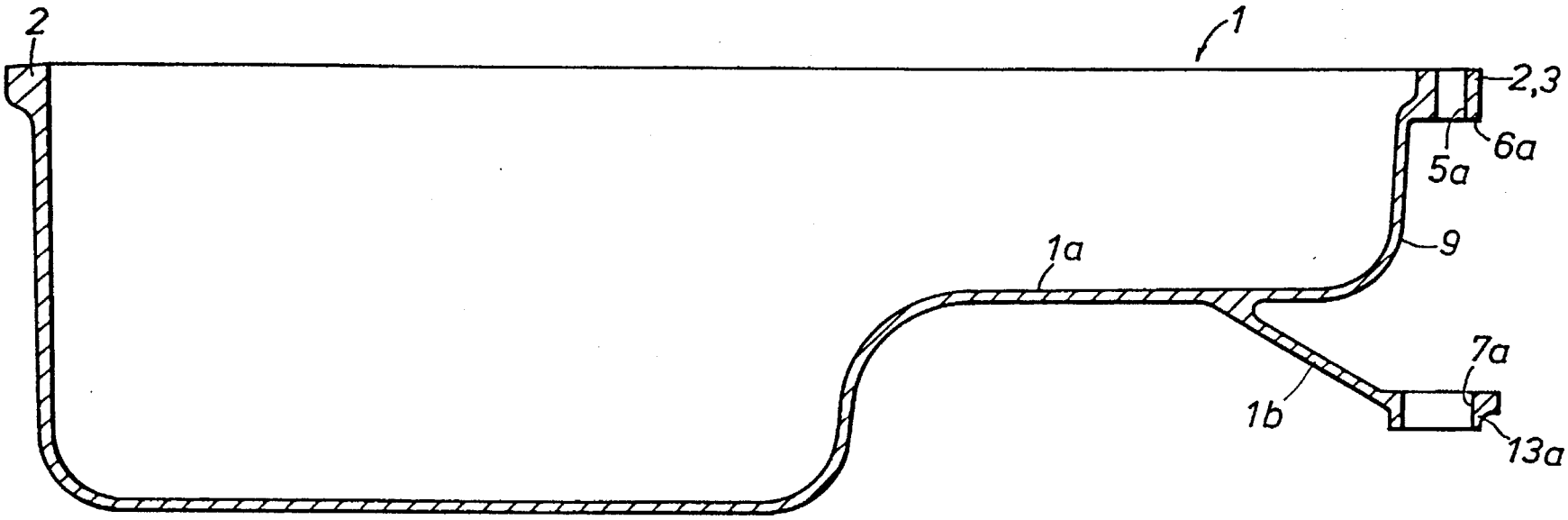
FIG. 2 is a sectional view taken along line II—II of FIG.

FIGS. 1 to 7 show a preferred embodiment of the oil pan for an internal combustion engine according to the present invention. The oil pan 1 is made of cast aluminum alloy, and has a generally pan-shaped bottom wall 1*a*. The upper edge of the bottom wall 1*a* of the oil pan 1 has an annular flange 2. The rear portion of the bottom wall 1*a* has an extension 1*b*, and the rear edge of the extension 1*b* defines an annular flange 3 for attachment to a transmission case in cooperation with the bottom wall 1*a* and the flange 2. The transmission case may accommodate an automatic transmission system including a fluid torque converter among other possibilities. Thus, the flange 2 has a substantially horizontal flange surface while the flange 3 has a vertical flange surface perpendicular to a central axial line of a crankshaft (not shown in the drawing). The flange 2 is used for attachment to a cylinder block, and the flange 3 is used for attachment to a transmission case.

A plurality of mounting holes 5 are provided in the annular flange 2. Two mounting holes 5*a* and 5*b* are located adjacent to the flange 3, and have respective seat surfaces 6*a* and 6*b* for supporting heads of mounting bolts. The bottom wall extension 1*b* adjacent to the lower end of the flange 3 has a pair of access holes 7*a* and 7*b* allowing access to the heads of the threaded bolts disposed in the mounting holes 5*a* and 5*b*. These access holes 7*a* and 7*b* are large enough for entry of a bolt fastening tool and are normally closed by plugs of rubber or other resilient synthetic resin material.

Figure 3:
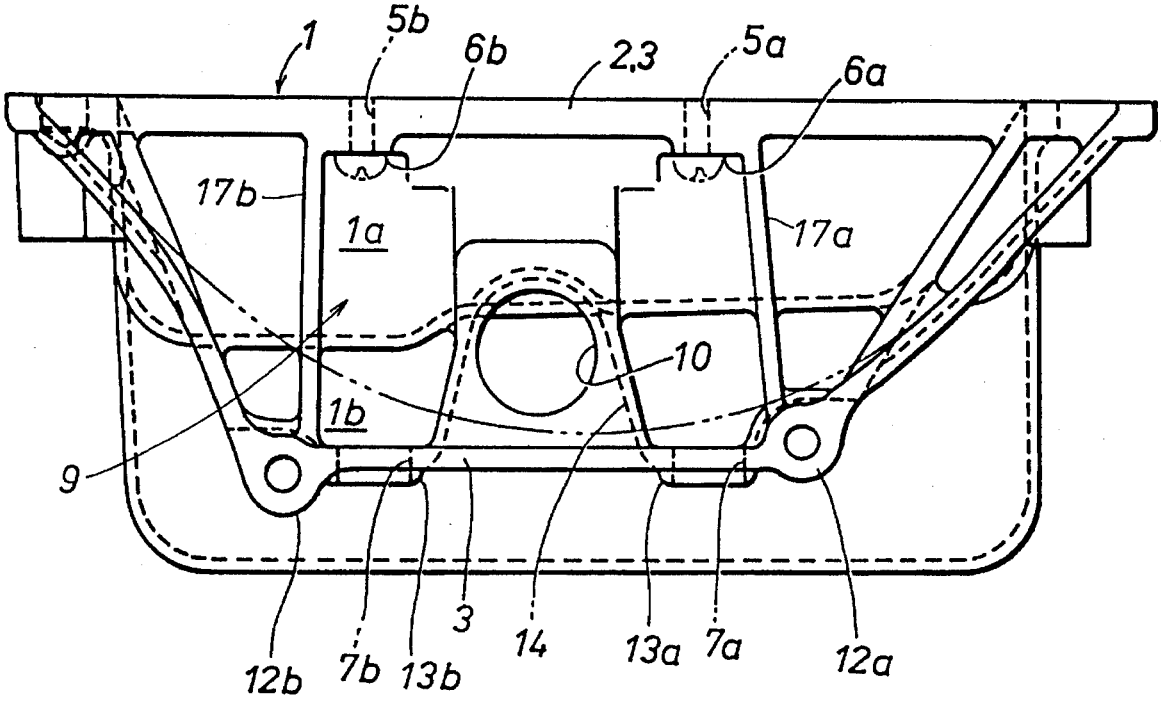
FIG. 3 is a front view of the oil pan.
Figure 4:
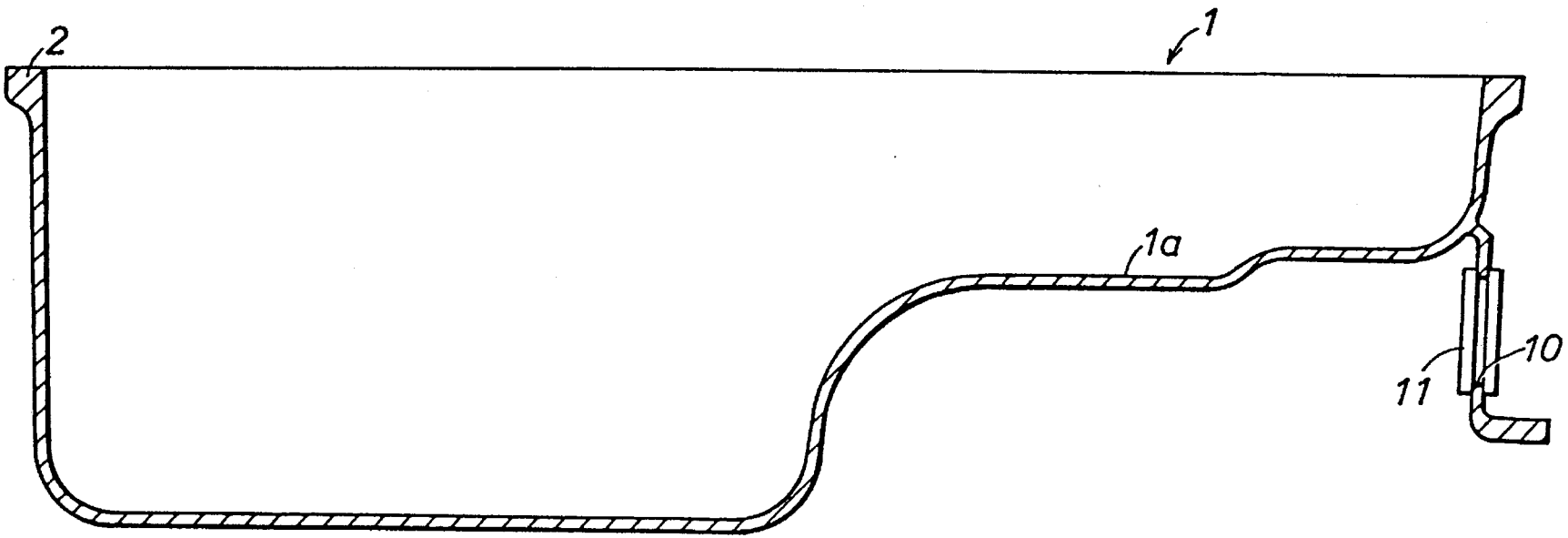
FIG. 4 is a sectional view taken along line IV—IV of FIG. 1.

Referring to FIGS. 3 and 4, a bottom wall extension 1*b* and the annular flange 3 border a central recess 9. The bottom wall extension 1*b* has a maintenance hole 10 and access holes 7*a* and 7*b*, for allowing access to a drive plate of a torque converter of the transmission system (not shown in the drawings) from the exterior of the oil pan. Mounting holes 5*a* and 5*b* are shown in FIG. 3. Thus, by removing the drive plate from this maintenance hole 10 and unfastening the mounting bolts from the flange 3, it is possible to remove the transmission case from the engine without removing the oil pan 1 from the engine. Therefore, the transmission case can be removed from the power unit without risking spilling lubricating oil from the engine or risking oil leakage. This maintenance hole 10 is normally closed by a plug 11. The plug 11 can be made of rubber or other resilient synthetic resin material, and is removed when the transmission case is serviced.

Figure 5:
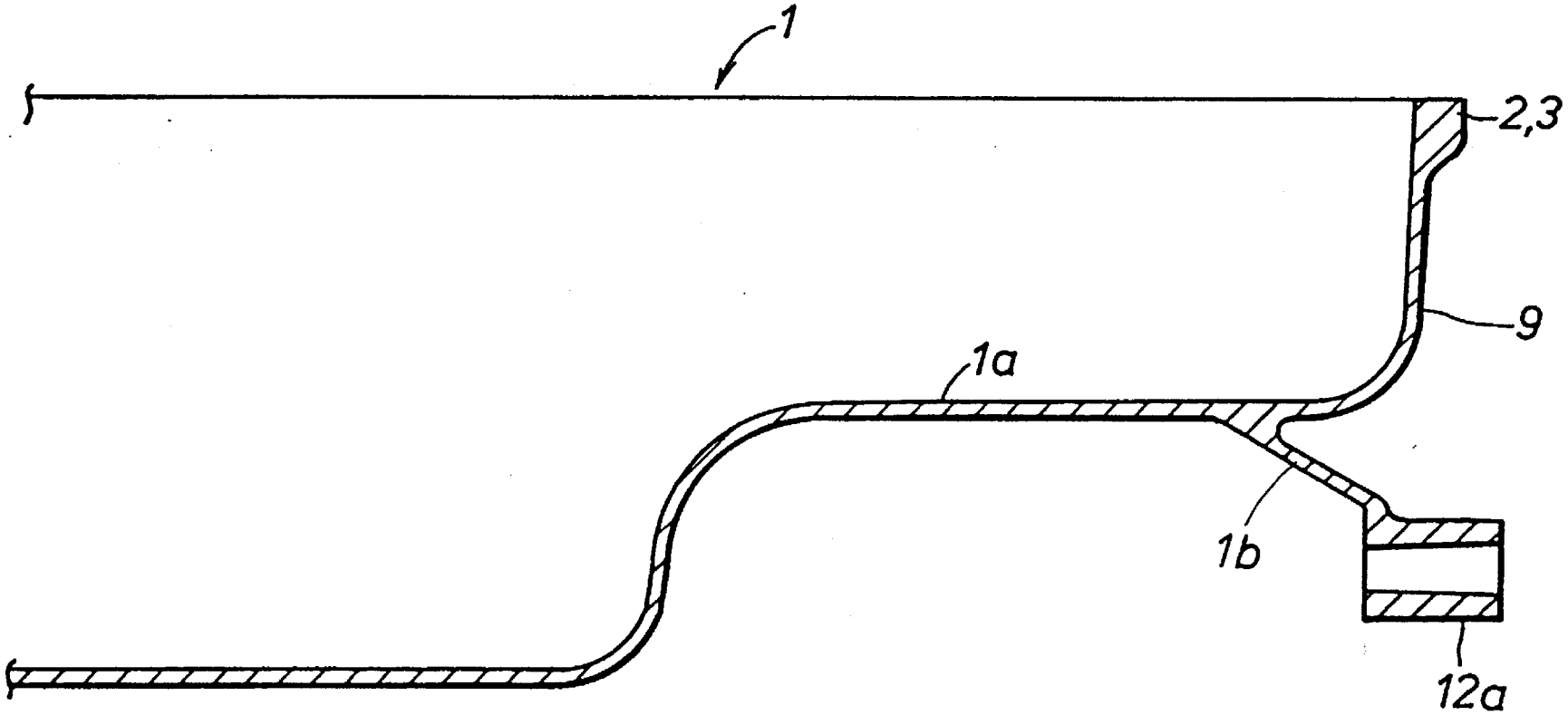
FIG. 5 is a sectional view taken along line V—V of FIG. 1.
Figure 6:
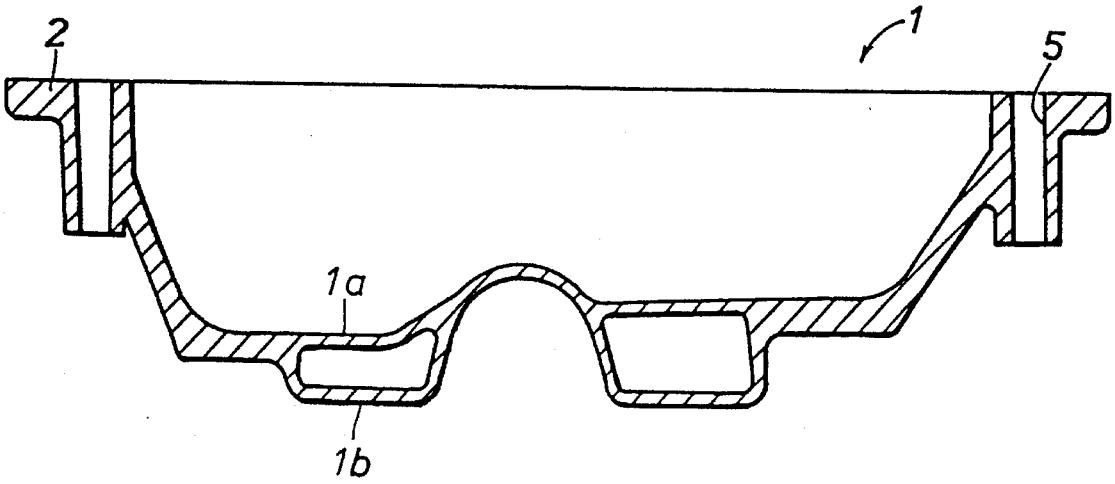
FIG. 6 is a sectional view taken along line VI—VI of FIG. 1.

As illustrated in FIGS. 1, 3 and 5, a pair of annular transmission mounting bosses 12*a* and 12*b* are adjacent to the access holes 7*a* and 7*b*. As best illustrated in FIG. 3, a pair of reinforcement ribs 17*a* and 17*b* are integrally provided in the bottom wall 1*a* and in the bottom wall extension 1*b* of the oil pan 1. The ribs 17*a* and 17*b* are respectively connected between the two annular flanges 2 and 3. In this embodiment, each of the reinforcement ribs 17*a* and 17*b* connects the slightly thickened seat region 6*a* surrounding one of the mounting holes 5*a* and 5*b* with a corresponding one of the transmission mounting bosses 12*a* and 12*b*.

Each of the access holes 7*a* and 7*b* are respectively surrounded by reinforcing annular ribs 13*a* or 13*b* which are joined by a U-shaped connecting rib 14 extending along the upper periphery of the maintenance hole 10. The connecting rib 14 has depth in a direction perpendicular to the flange surface of the flange 3. The connecting rib 14 is a semi-cylindrical wall in the bottom wall 1*a*. This semi-cylindrical wall defines a concave surface on the exterior of the bottom wall of the oil pan, and has a sufficient axial length to allow insertion of a special tool for the removal of a drive plate.

Figure 7:
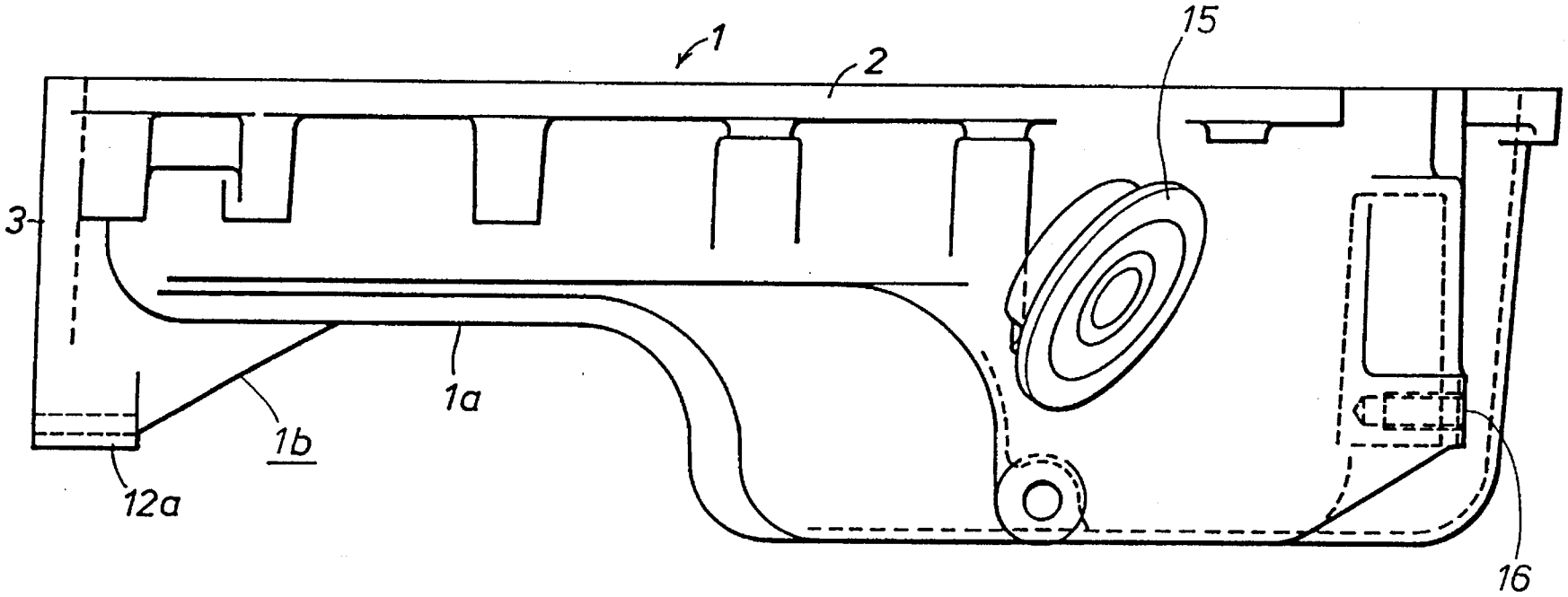
FIG. 7 is a side view of the oil pan.

The annular ribs 13*a* and 13*b* are also respectively connected to the bosses 12*a* and 12*b* of the mounting holes for the flange 3. Thus, the connecting rib 14, the reinforcement ribs 17*a* and 17*b*, the transmission mounting bosses 12*a* and 12*b* and the annular ribs 13*a* and 13*b* merge with each other at two regions adjacent to the transmission mounting bosses 12*a* and 12*b*. In FIGS. 1 and 7, numeral 15 denotes a seat surface of an oil filter canister, and numeral 16 denotes a seat surface for an engine mount.

When installing the oil pan 1 on an engine, the oil pan 1 is fitted on the open bottom end of the cylinder block, and threaded bolts are inserted in the mounting holes 5. The seat surfaces 6*a* and 6*b* for the heads of these mounting bolts provided in the flange 2 allow heads of the bolts to be directly applied to the flange 2 without requiring long bolt stems or long bosses in the oil pan. As a result, a sufficient sealing performance can readily be achieved. In particular, because no bolt stems pass across the recess 9, there is greater freedom of design. For instance, it is possible to increase the clearance between the flywheel of the engine and the recess 9, and the tuning of the mass of the flywheel can be facilitated.

As discussed above, according to the oil pan of the present invention, access holes are provided in the oil pan, and mounting bolts used in the mounting holes of the flange are used for attachment of the flange to the cylinder block such that heads of the bolts are directly applied to the flange. Thus, a sufficient sealing performance can be achieved without any difficulty. Furthermore, annular ribs surround the access holes, and are connected with each other by a rib structure, thereby imparting a sufficient rigidity to the flange. The rib structure may include a part of the bottom wall of the oil pan.

Although the present invention has been described in terms of a preferred embodiment thereof, it is obvious to a person skilled in the art that various alterations and modifications are possible without departing from the scope of the present invention which is set forth in the appended claims.

What we claim is:

1. An oil pan made of cast metal or alloy for an internal combustion engine, comprising:

a main body including a pan-shaped bottom wall, a first annular flange for attachment to a cylinder block defined circumferentially along an upper of said main body, and a second annular flange for attachment to a transmission case defined by an longitudinal end of said oil pan main body and a bottom wall extension of said main body, said first and second annular flanges defining substantially perpendicular flange surfaces intersecting at a longitudinal end of said main body;

a plurality of first mounting holes provided circumferentially along said first flange;

a plurality of second mounting holes provided circumferentially along said second flange;

access holes provided in said bottom wall extension adjacent to a bottom end of said second flange for allowing access to heads of mounting bolts which are passed into some of said first mounting holes, with said heads placed substantially directly on said first flange, said access holes being dimensioned for a bolt fastening flange, said accessed to said heads of mounting bolts from said access holes;

an annular rib formed around each of said access holes; and a connecting rib defined by a part of said bottom wall so as to have a certain depth in a direction perpendicular to said flange surface of said first flange and connect said annular ribs with each other.

2. An oil pan for an internal combustion engine according to claim 1, further comprising annular bosses each surrounding one of said second mounting holes, said connecting rib being additionally connected to said annular bosses.

3. An oil pan for an internal combustion engine according to claim 2, further comprising a maintenance hole passed through said bottom wall extension so as to allow access to an opposing surface of said transmission case from exterior of said oil pan, and at least part of said connecting rib is defined by sections of a semicylindrical part of said bottom wall extension surrounding said maintenance hole.

4. An oil pan for an internal combustion engine according to claim 2, further comprising a pair of reinforcement ribs defined by parts of said bottom wall and each extending from said first flange and to a part of said second flange adjacent to a corresponding one of said annular bosses.

* * * * *